United States Patent [19]

Sickles et al.

[11] 4,106,697

[45] Aug. 15, 1978

[54] SPRAYING DEVICE WITH GAS SHROUD AND ELECTROSTATIC CHARGING MEANS HAVING A POROUS ELECTRODE

[75] Inventors: James E. Sickles, Glenshaw; Joseph V. Hornyak, Lower Burrell; Helmut Franz, Pittsburgh, all of Pa.

[73] Assignee: PPG Industries, Inc., Pittsburgh, Pa.

[21] Appl. No.: 742,294

[22] Filed: Nov. 16, 1976

Related U.S. Application Data

[63] Continuation-in-part of Ser. No. 718,633, Aug. 30, 1976, abandoned.

[51] Int. Cl.[2] ..... B05B 5/02; B05B 12/12

[52] U.S. Cl. ..... 239/15; 239/291

[58] Field of Search ..... 239/3, 15, 290–301

[56] References Cited

U.S. PATENT DOCUMENTS

| | | | |
|---|---|---|---|
| 1,219,642 | 3/1917 | Isaacs | 239/300 |
| 2,410,532 | 11/1946 | Tessier | 239/291 |
| 3,065,106 | 11/1962 | Rhodes et al. | 239/15 |
| 3,940,061 | 2/1976 | Gimple et al. | 239/15 |
| 3,952,951 | 4/1976 | Raetz et al. | 239/291 X |
| 4,004,733 | 1/1977 | Law | 239/290 X |
| 4,009,829 | 3/1977 | Sickles | 239/15 |

*Primary Examiner*—Robert W. Saifer
*Attorney, Agent, or Firm*—J. Timothy Keane

[57] ABSTRACT

A spraying device having a liquid dispersing nozzle mountable in association with a chamber for directing a stream of gas can be used to provide a spray stream enveloped within a shroud of temperature and humidity conditioned air or gas for controlled evaporation of solvent from spray particles or for preventing reaction of particle components with the ambient atmosphere, and/or to prevent particle deposition and build-up on electrodes positioned so as to produce electrostatically charged particles.

38 Claims, 13 Drawing Figures

FIG. 4
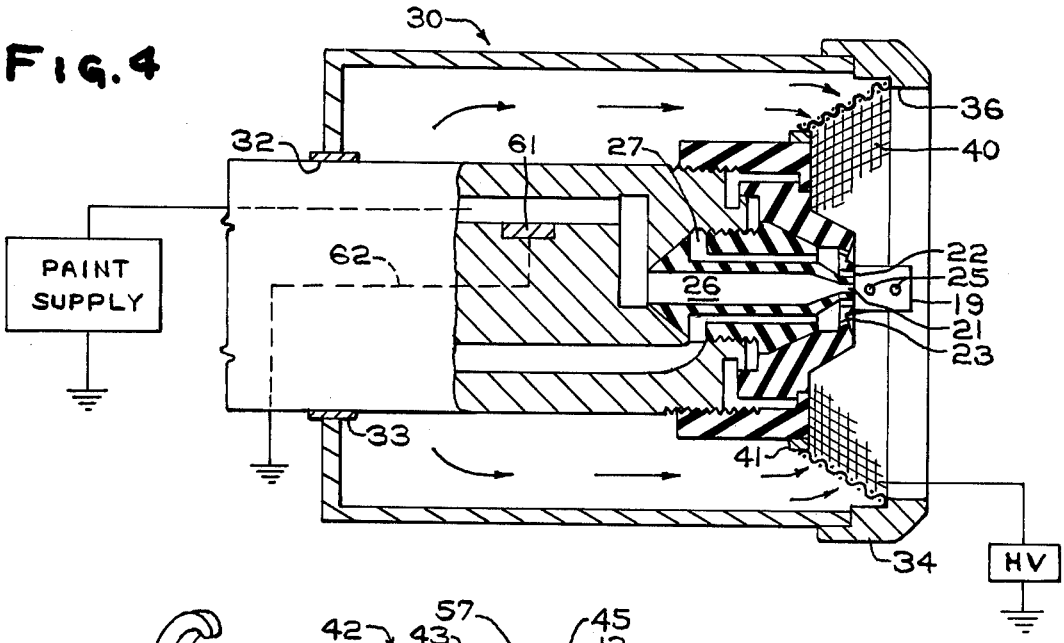
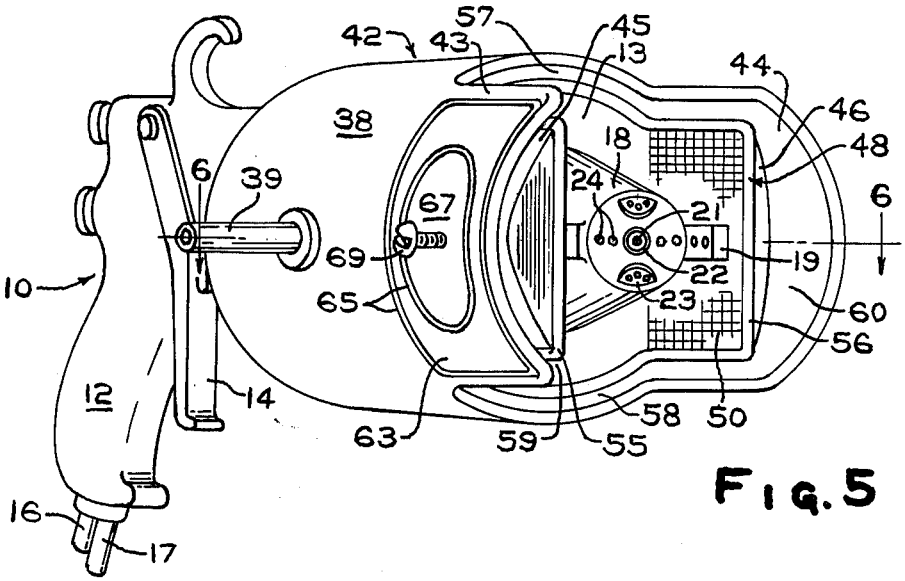
FIG. 5
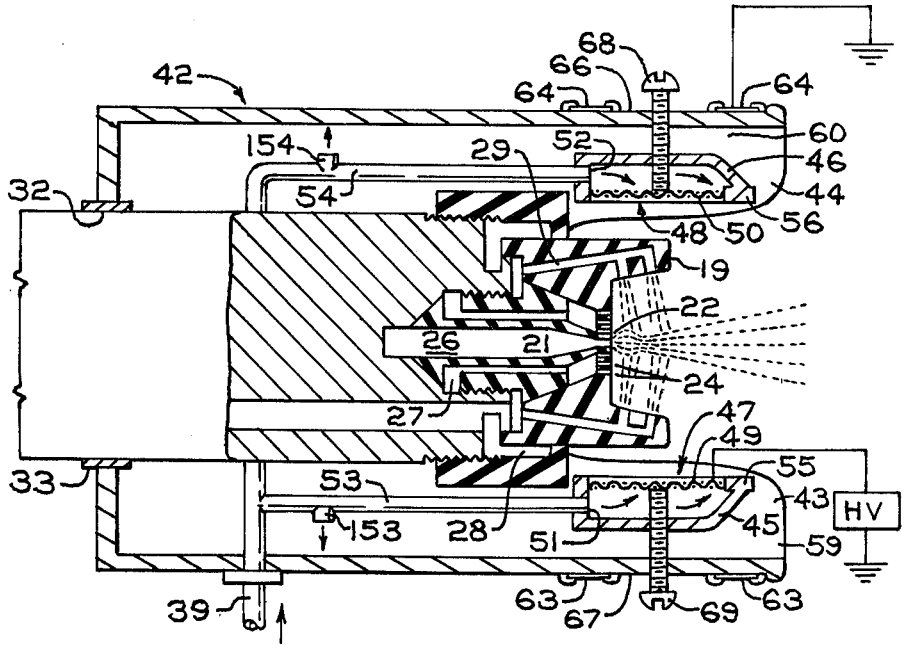
FIG. 6

FIG. 7
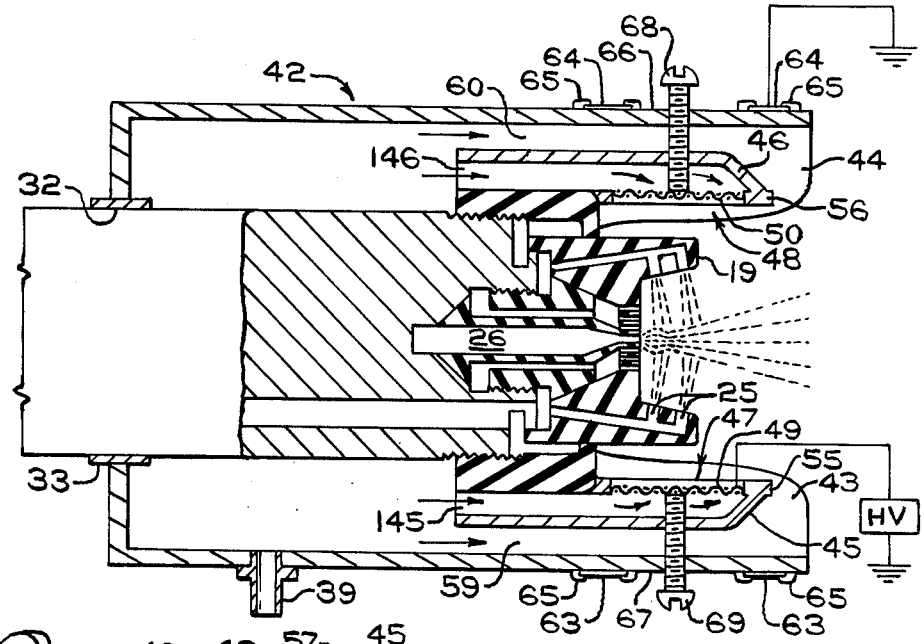
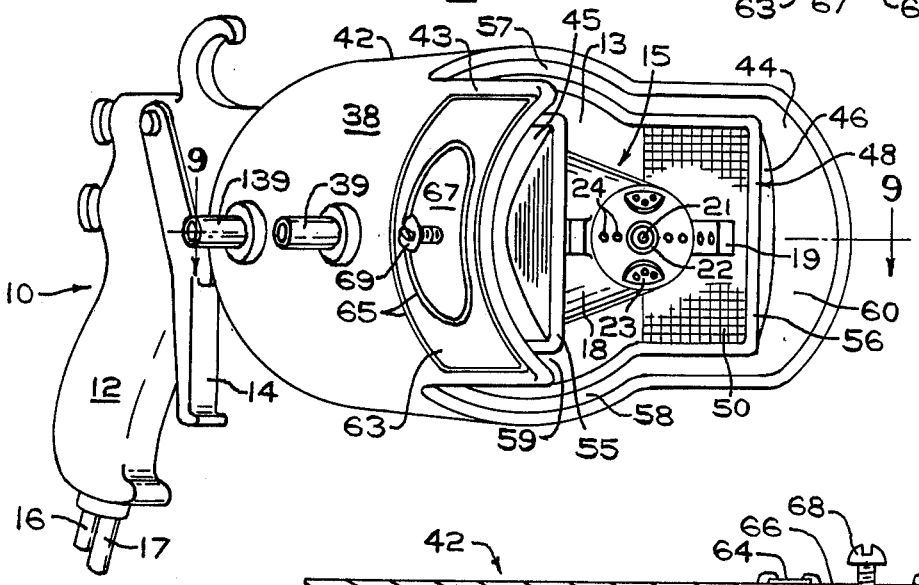
FIG. 8
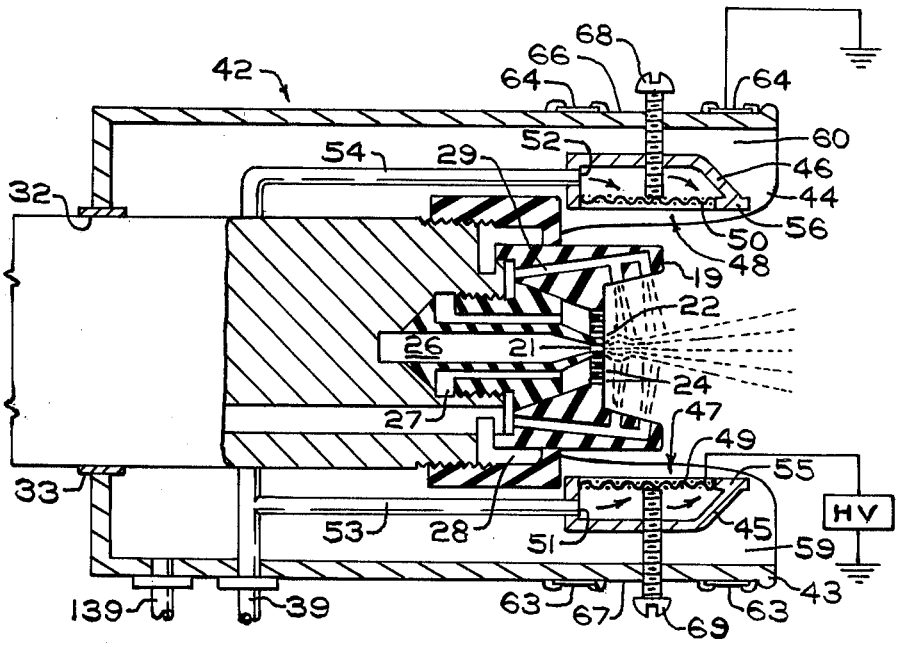
FIG. 9

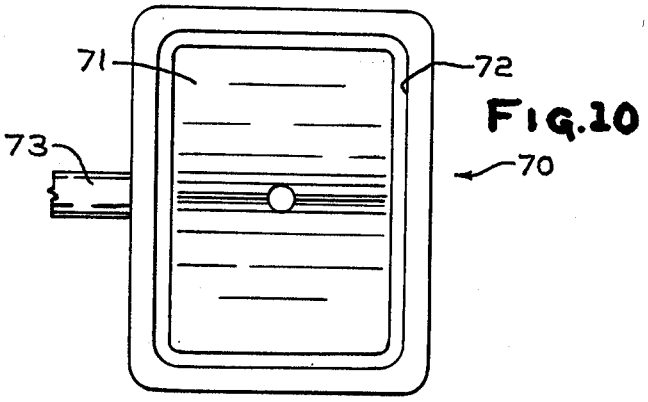
FIG. 10
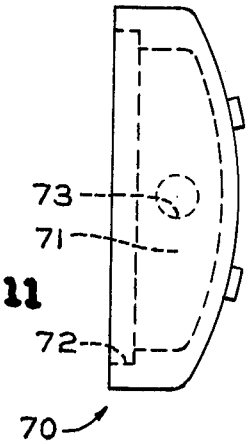
FIG. 11
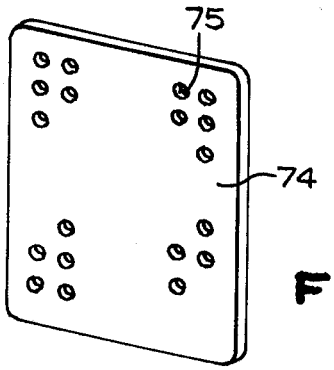
FIG. 12
FIG. 13
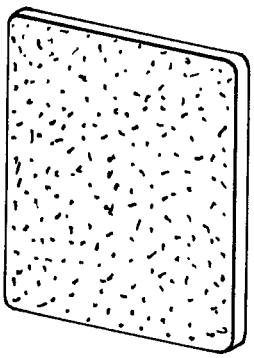

SPRAYING DEVICE WITH GAS SHROUD AND ELECTROSTATIC CHARGING MEANS HAVING A POROUS ELECTRODE

CROSS-REFERENCE TO RELATED APPLICATION

This application is a continuation-in-part of copending application Ser. No. 718,633, filed Aug. 30, 1976, now abandoned.

BACKGROUND OF THE INVENTION

1. Field of the Invention

This invention relates to devices for spray application of coating materials, and more particularly to spraying devices for achieving uniform application of a wide variety of liquid coating compositions to a workpiece in ambient conditions generally adverse to the spray application of such coating materials.

2. State of the Art

The advantages of spray application of clear and pigmented coating materials such as oil- and water-based acrylic primers, paints, lacquers, enamels and varnishes to various substrates are well known. Good spray-applied coatings characteristically result in films of uniform gloss and thickness without the undesirable aspects of streaking, sagging or blotchiness frequently produced by brushing, rolling or dipping techniques. On the other hand, spray application of coating materials requires more costly equipment, the use of which must take into account several critical parameters. For example, successful deposition of a coating material on a workpiece entails firstly that the atomization process, that is, the formation of discrete droplets of coating material, create a stream of dispersed droplets of the finest particle size possible with a range of variation in particle size as narrow as possible. Secondly, achievement of a deposited film of uniform gloss and thickness is dependent upon efficient transfer and adherence of the solid material carried by the spray droplets to a workpiece.

It is well known that transfer efficiency and film build-up are greatly affected by the relative humidity and temperature of the atmosphere through which the stream of spray droplets must travel. This is because a large portion of the coating material comprises a volatile component which must be driven from the remaining coating solids before effective adherence is accomplished. Controlled partial evaporation of the volatile component is desired during particle travel to the workpiece, but such partial evaporation is hindered, especially in the spray application of water-based coatings, by high ambient atmospheric relative humidity, and can be further hindered by too low ambient temperatures; too high ambient temperature, on the other hand, tends to reduce deposition efficiency by overdrying the droplets. If the ambient humidity is too high, partial evaporation occurs only to a slight extent which results in a deposited film characterized by mottling, sags or runs. On the other hand, if the ambient humidity is too low, partial evaporation may be excessive, thereby resulting in poor transfer efficiency and graininess at the film surface.

Hence, successful use of spray coating techniques has heretofore been largely limited to applications where the coating material is of the volatile organic-based type less affected by high relative humidities, or to applications where water-based coating materials can be applied under controlled conditions of ambient humidity and temperature. Because of the obviously high costs in providing a temperature and humidity conditioned atmosphere to house a workpiece to be coated, especially in the instance of workpieces comprising industrial equipment, vehicle chassis, or even a building, it has been much preferred to utilize organic-based coatings over the water-based equivalents.

The advent of spray coating devices utilizing electrostatic charging means to impart electrical charge to spray particles, by either corona-produced ion bombardment of the particles or by inducing charge directly thereon, has improved the uniformity and fineness of spray particle size and the efficiency of particle transfer to, and deposition on, the workpiece. Electrostatic techniques alone have not, however, overcome the problems arising from use of water-based coatings under ambient conditions of high relative humidity. Yet, the need for a spraying system enabling the utilization of water-based coatings under widely varying conditions of humidity has been accentuated recently by a combination of factors, including stringent regulations imposed by State and Federal governments upon users of volatile organic solvents, requiring such users to minimize emission of solvents to the atmosphere, and by increased costs of petroleum derived compounds such as xylene, toluene and methylene chloride typically utilized as solvents in organic-based coating materials.

One recent attempt at solving the aforementioned problems is described in U.S. Pat. No. 3,857,511 issued to T. S. Govindan on Dec. 31, 1974, which is directed to a process of applying water-based acrylic paint from a conventional air-atomizing spray gun, wherein a cone or shroud of humidity- and temperature-conditioned air is formed around a stream of paint particles. Because of the configuration of Govindan's air shroud producing structure, however, the aforementioned problems of spraying water-based coatings in an ambient atmosphere of high relative humidity remained to be solved. Furthermore, it has been found that a spray device having the Govindan type air-shroud producing means is particularly unsuited for use in combination with electrostatic charging means because of turbulence created by the angularly directed shroud air which increases rather than impedes deposition of coating particles on the electrodes.

Spraying methods are also useful in the manufacture of other products, such as the application of materials to glass to form tinted glass, mirrors or laminates. Where the glass substrate is in a heated condition, or where a very thin layer of coating material must be applied to the glass surface, application of material by spraying may be the only practical method for achieving a uniformly coated substrate. When spraying rapidly oxidizable coating materials onto glass substrates, it is often necessary to exclude atmospheric oxygen or moisture from the region of particle travel to prevent unwanted reactions of particle components with the ambient atmosphere, such as premature oxidation or hydrolysis, for proper coating deposition on the substrate. In the case of electrostatic spray coating of non-conductive substrates such as wood, plastic or glass, it may be necessary to ensure that the workpiece is made sufficiently conductive by controlling the level of moisture at the surface whereby excess charge of deposited particles is drained from the workpiece surface to the atmosphere. Exclusion of oxygen and a controlled moisture level can each be accomplished by providing an envelope of appropriately conditioned gas to surround the spray stream as it travels to the workpiece.

The gas envelope forming structure of the present invention may also be used in coating systems in which the dispersing apparatus is of a type used for application of dry or slurry-based powder coatings. The device is especially useful in dry powder coating processes wherein the powder is electrostatically charged to improve deposition. Frequently, when dry powder coatings are subjected to a high voltage field in an ambient atmosphere of low humidity, sparks may ignite the powder-air mixture causing dangerous fires or explosions. The provision of an envelope of humidified air or inert gas around a stream of the powder coating material practically eliminates any tendency for the powder to ignite.

SUMMARY OF THE INVENTION

A spray coating device is now provided which, used with various dispensing means, yields spray-deposited coatings of desired surface finish characteristics and which can be used in ambient atmospheric conditions of practically any range of relative humidity to apply a wide variety of coating compositions, including the water-based type. The spray coating device of the present invention is especially suited for use with electrostatic charging equipment and particularly spray equipment with inductive charging means. The new spraying device is also useful for spray-applying oxygen-sensitive coatings to glass and other substrates and can be used to provide a controlled atmosphere of humidity within a range that allows use of electrostatic induction charging of particles for deposition on non-conductive substrates.

The new spray device comprises a chamber, which is conveniently cylindrical in shape, near one open end of which there is mounted spray dispersing means capable of forming liquid coating material into a stream of discrete droplets that exits the open end of the chamber.

Typically, the spray dispersing means can be of a type which atomizes coating material by discharge of pressurized liquid through a constricted port into a stream of high velocity air passing by the constricted liquid port. Such air atomization spraying devices are well known and are generally characterized as either of the "external" or "internal" nozzle mixing types. This classification is based upon whether coating atomization takes place within the confines of a nozzle passageway enclosing the air and liquid discharge ports, or whether atomization is effected in some region exterior to the nozzle. Shown in U.S. Pat. No. 3,698,635 to James E. Sickles is an air-atomization spray device of the internal mixing type, and in U.S. application Ser. No. 634,386 to James E. Sickles, filed Nov. 24, 1975 and now abandoned, is a device of the external mixing variety. Also employable in this invention are various other well-known liquid coating material atomizing devices, namely siphon- or aspiration-type liquid atomizers, and hydraulic-atomizing spray devices in which atomization is accomplished by thrusting liquid coating material into the spraying region under very high pressure through a constricted orifice without the dispersing effect of an accompanying high velocity air stream.

The spray device of this invention can be used to apply a wide variety of coating materials by various conventional spraying techniques under widely diverse atmospheric conditions of relative humidity and temperature. This is accomplished by providing a chamber of pressurized gas enclosing a portion of the spray device to create a gaseous envelope which travels substantially parallel to the emerging stream of spray particles and surrounds the spray with an artificial atmosphere of conditioned air of predetermined parameters of relative humidity and temperature. Since the gas envelope temperature and humidity parameters can be closely controlled, the critical period of initial drying of coating material particulate on its way to deposition on the workpiece can be established to suit the solvent composition of the coatings and the nature of the workpiece substrate. The gas envelope is created from a source which can be independent of the ambient atmosphere, and thusly, a wide variety of coating materials, including water-based coatings particularly, can be applied to a workpiece with optimum results regardless of ambient conditons. Additionally, the use of an envelope consisting of nitrogen or other inert gas provides a protective atmosphere for oxygen-sensitive coatings as the stream of particles travels to the target.

The present invention is uniquely and advantageously utilized in spray devices incorporating electrostatic charging means. In conventional electrostatic spray guns, charged particles of the dispersed coating material often deposit upon the electrodes. In electrostatic spray devices utilizing the induction charging method wherein the polarity of the charging electrode is opposite that of the spray stream particles, the problem of deposition of the particles on the electrodes is especially acute. Although such deposits do not usually affect the intensity or configuration of the electric field established by the electrodes, coating material may continue to build up on and then break free of the electrodes in the form of a large slug-like agglomerate of partially dried material, which agglomerate is then usually carried in the spray stream to the workpiece, whereupon the formation of a smooth, even film is prevented. This "slugging" phenomenon is avoided in the present invention by positioning the electrodes in a portion of the gas stream so that spray particles are swept away from the electrode.

Although the invention is described and exemplified in more detail in the following description and the accompanying drawings, it should be understood that changes may be made in the specific embodiments disclosed without departing from the essentials of the invention set forth in the appended claims.

BRIEF DESCRIPTION OF THE DRAWINGS

The accompanying drawings illustrate examples of embodiments of the invention constructed according to the best mode so far devised for the practical application of the principles thereof, and in which:

FIG. 4 is a partial sectional view of a side elevation of the apparatus of FIG. 3 taken along line 4—4;

FIG. 5 is a perspective view of another embodiment of the spray gun-chamber electrode means combination of FIG. 3 to which shielding electrode means have been added;

FIG. 6 is a partial sectional view of a top plan of the apparatus of FIG. 5 taken along line 6—6;

FIG. 7 is a partial sectional view of a top plan of the apparatus of FIG. 5 taken along line 6—6 showing an alternate structure for directing a flow of air or other gaseous substance through the chamber attached to a spray gun;

FIG. 8 is a perspective view of another embodiment of the spray gun-chamber-electrode means-shield means combination of FIG. 5 showing a second gas inlet added to the gas envelope forming chamber.

FIG. 9 is a partial sectional view of a top plan of the apparatus of FIG. 8 taken along line 9—9.

FIG. 10 is a side elevation view of a chamber for delivering gas or air to an electrode mountable in the mouth of the chamber;

FIG. 11 is an elevation view of the front end of the chamber shown in FIG. 10; and FIGS. 12 and 13 are perspective views of porous, slab-like electrode members mountable in the chamber of FIG. 10.

DESCRIPTION OF THE PREFERRED EMBODIMENTS

Figure 1:
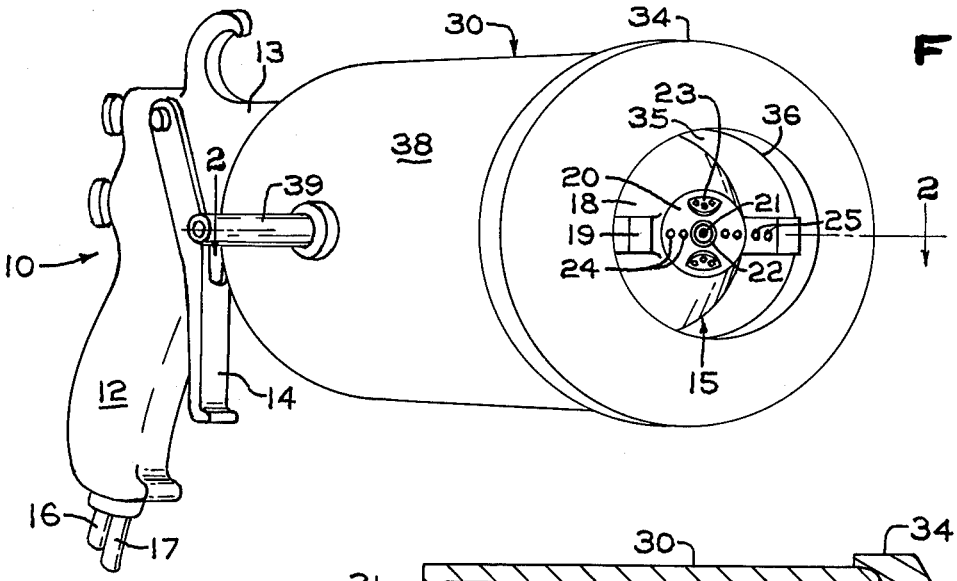
FIG. 1 is a perspective view of a conventional hand-held spray gun, shown in diagrammatic form, having a chamber adapted to provide a gaseous envelope in accordance with the present invention.
Figure 2:
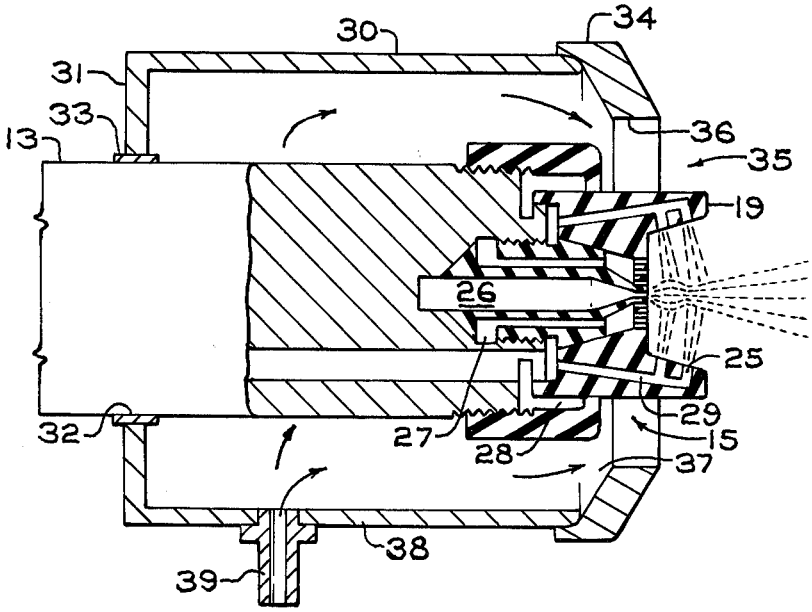
FIG. 2 is a partial sectional view of a top plan of the spray gun-chamber combination taken along line 2—2 of FIG. 1.

Referring now to the drawings, and more particularly to FIGS. 1 and 2, there is depicted generally by numeral 10 a conventional hand-held air atomizing spraying device having a handle portion 12, a barrel 13, a trigger mechanism 14 and a nozzle assembly 15 threadedly engaged with the barrel forward end portion. Liquid coating material and atomizing air or other gas are fed from sources (not shown) through separate feed hoses connected by suitable means 16 and 17, respectively, located on handle 12. Conventional valve means (not shown) monitor flows of liquid and gas, with trigger mechanism 14 operatively connected to the valve means for controlling flow of the pressurized liquid coating material through internal passageways to nozzle assembly 15.

Nozzle assembly 15 is of the conventional "external-mixing" type having an air cap 18 with integrally formed air horns 19. Non-electrostatic spray gun apparatus, such as is shown in FIGS. 1 and 2, may have a nozzle assembly fabricated of either electrically conducting or non-conducting material. In spray gun embodiments in which there are associated electrode means for electrostatic charging of the spray stream, it is preferred that air cap 18 and other portions of the nozzle structure be constructed of dielectric or electrically non-conductive material such as acetal resins, epoxy resins, glass filled epoxy resins, glass filled nylon, and the like. Nozzle means fabricated of dielectric material is especially preferred in electrode-containing spray devices in which electrostatic charging is accomplished by the inductive charging process.

Upon face 20 of nozzle assembly 15, there is a centrally located liquid discharge port 21 with a concentrically disposed annular-shaped atomizing air discharge port 22. Simultaneous discharge of liquid and pressurized air from these ports creates a stream of finely divided droplets or particles of coating material which is propelled outwardly of nozzle face 20. Ports 23 and 24 flanking the spray forming ports discharge relatively high velocity jets of air which aid in initially confining the stream of atomized coating material to a small volume of space and to shaping the stream. Ports 25 located on outwardly projecting air horns 19 discharge jets of air which further aid in shaping of the stream of coating material droplets into a fan configuration desired for most spraying applications.

Within nozzle assembly 15, illustrated in FIG. 2, a central passageway 26 conveys liquid coating material from inlet 16 through barrel 13 to liquid discharge port 21. Flanking passageway 26 are passageways 27, 28 and 29 which, respectively, feed air to atomizing air port 22, to stream shaping ports 23 and 24, and to fan shaping air horn ports 25.

In accordance with the present invention, there is mounted on barrel 13 of spraying device 10 support means comprising a tubular-shaped chamber 30 having mounting means which comprises end wall 31 at opening 32. A resilient grommet 33 can be used to aid in forming a seal between the barrel and chamber end wall 31. Chamber 30 is mountable upon spray device barrel 13 by any conventional mounting means and can be formed as an integral part of the barrel itself during manufacture of the spraying device, if so desired, or can be manufactured separately as an adapter for various sizes and types of spray guns. The illustrated mounting means enables the chamber support means to slide along the barrel to provide quick and precise adjustment of the chamber in relation to the nozzle assembly and is easily detachable from the spray device for cleaning purposes after removal of the conventionally threaded nozzle assembly. The tubular chamber is normally positioned on barrel 13 so that the forward end portion of chamber 30 extends to encompass substantially entirely the axially positioned nozzle assembly 15.

In the embodiment illustrated in FIG. 2, chamber 30 has a pressure fitted end cap 34 with a generally circular shaped opening 35 therein through which air horns 19 project. Perimeter edge portions 36 of opening 35 cooperate with concentrically disposed surface portions of the barrel mounted nozzle assembly 15 to define annular shaped region 37 at the forward end of the spray device. Upon a portion of chamber side wall 38 spaced from the opening through which the spray stream discharges, there is located an inlet 39 for delivery of a flow of gas at a positive pressure. The source of this gas may be the same compressed air as used for the air-atomization of the coating material, which is normally of low moisture content; or, the source can include heating, cooling, dehumidifying or moisture adding means to deliver conditioned air of desired characteristics. Also, other kinds of gases may be supplied to the chamber to provide an artificial atmosphere around the spray stream suitable for a particular combination of coating material, ambient atmosphere and substrate. For example, some coating materials are highly oxygen sensitive and tend to begin the curing reaction before the material reaches its target. A shroud of an inert gas such as nitrogen will exclude atmospheric oxygen for a period of time necessary for coating particles to travel from the gun to the substrate. On the other hand, some materials may need an excess of oxygen or a catalyst to accelerate curing during travel of the coating particles to the substrate, which catalyst or excess oxygen may be supplied to the coating material from a shroud of gas encircling the particle stream.

As mentioned, chamber 30 is mounted upon barrel 13 at chamber end wall 31 so that substantially all conditioned air or gas introduced through inlet 39 flows outward of opening 35 in end cap 34. Since nozzle assemble 15 is axially situated in opening 35 thereby defining an annular-shaped passageway 37, gas will exit the passageway in a configuration of doughnut-shaped cross-section providing an envelope of gas partly or wholly surrounding the stream of coating material emanating from centrally disposed concentric liquid and air nozzle ports 21 and 22. This provides a controlled region between the spray gun and the target workpiece, for example, to effect partial evaporation of water from the coating droplets traveling through an ambient atmosphere of any value of relative humidity. The parameters of spray fan configuration, annular cross-section, coating and atomizing air flow velocities, and gas envelope velocity, can each be easily adjusted by, respectively, substituting a nozzle with different port configuration, by adjusting the position of the slidable chamber on the barrel, and by altering the coating and gas source pressures.

Figure 3:
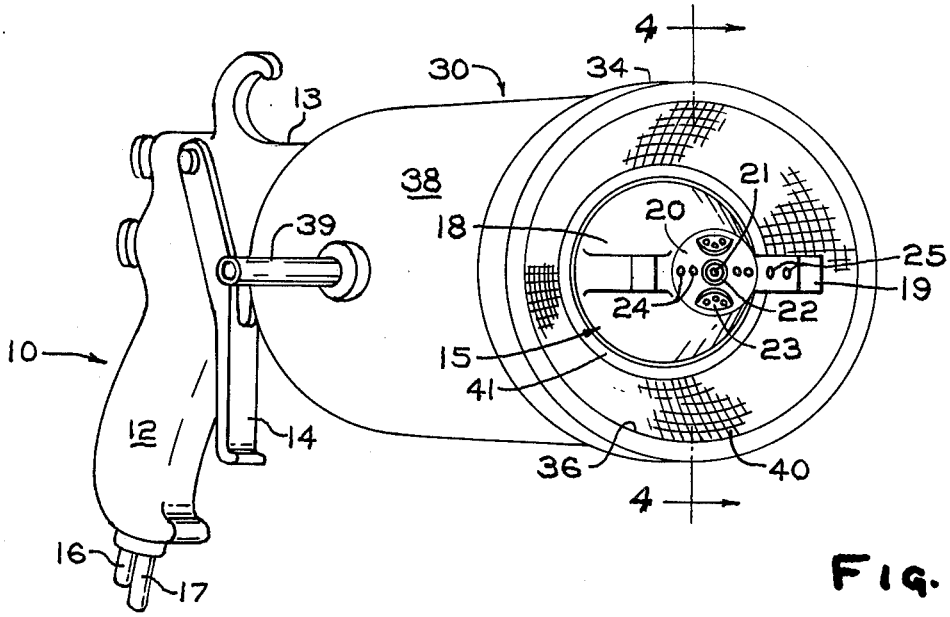
FIG. 3 is a perspective view of another embodiment of the spray gun-chamber combination in which electrode means have been included.

The gas-envelope spray gun device of this invention is particularly applicable to spraying equipment which utilizes electrostatic charging of coating particles to increase transfer efficiency of coating material to a workpiece. FIGS. 3–9 illustrate two embodiments in which variant configurations in the gas-envelope forming chamber are used with induction charging electrodes in combination with conventional hand-held spray devices. In FIGS. 3 and 4 a tubular chamber 30 has a pressure fitted end cap 34 like that shown in FIGS. 1 and 2 fabricated of a dielectric material. Fixedly attached to and extending from the inner perimeter edge 36 inward toward the base of air cap 18 is electrode 40 formed of a wire mesh screen or grid in a cup-shaped configuration terminating at an innermost circular edge concentric with the base of nozzle assembly 15. A bead 41 of dielectric material serves both to rigidify the screen and to suppress corona discharge at the inner edge sharp ends of the screen grid wires.

In a manner similar to that hereinbefore discussed, chamber 30 of the spray gun depicted in FIGS. 3 and 4 is fitted with gas inlet means 39 which supplies a gaseous substance of desired characteristics to the chamber for formation of a moving envelope to surround a spray stream of coating material. In this embodiment, the gas consists of temperature and humidity conditioned atmospheric air which sweeps continuously through the pores of electrode grid 40 so as to keep particles of coating material from depositing upon the electrode grid. Besides keeping the electrode free of deposited spray particles, which is an important advantage, the quite troublesome aforementioned problem of slugging is practically eliminated inasmuch as formation of agglomerates is prevented.

Illustrated in FIGS. 5–9 is another variation in means for forming a gas into an envelope and means for directing a flow of gas into contact with an electrode assembly on a spray gun device constructed in accordance with the present invention. In this embodiment, instead of an end cap mounted on the forward end of the chamber, the cylindrical forward end portion of tubular chamber 42 terminates in a plane at the base of nozzle assembly air cap 18. Integrally formed with the chamber forward end portion are two diametrically opposed arcuate lobes 43 and 44 extending substantially forwardly of nozzle assembly air horns 19. Lobes 43 and 44 extend generally arcuately along segments of the perimeter of the cylindrical chamber forward end portion so as to define a region partially enclosing nozzle assembly 15. Extending forwardly from the plane of the base of nozzle assembly air cap 18 and coterminous with lobes 43 and 44 is a pair of chambers 45 and 46 having arcuate outer wall portions generally concentric with arcuate lobes 43 and 44. Hollow portions of chambers 45 and 46 open to rectangular-shaped mouths 47 and 48 which are in facing relationship to each other and to nozzle assembly 15.

Positioned within chamber mouths 47 and 48 are complementary shaped rectangular screen like grid electrodes 49 and 50. As shown in FIG. 6, chambers 45 and 46, preferably constructed of dielectric material, have inlets 51 and 52 for admitting gas to the chambers. Passageways 53 and 54 connect chambers 45 and 46, respectively, with a common source of gas at inlet 39, which inlet also furnishes gas to chamber 42 through passageways 153 and 154 for forming an annular gaseous envelope for the purpose hereinbefore described. Around the perimeter of each grid electrode positioned within chambers 45 and 46 are beads 55 and 56 which serve to hold the electrodes within the mouths of the chambers and to suppress development of corona ion formation or discharge. During operation of the spray gun, a continuous flow of gas or conditioned air is fed to chambers 45 and 46 and exits through the pores in the grid of the electrodes mounted in the mouths of the chambers so as to form a cushion or wall of gas above the electrode surfaces such that the electrostatic attractive forces drawing the particles to the electrodes are overcome by the aerodynamic forces of the air moving through the electrodes, which thereby prevents deposition of coating material on the grids. Alternatively, the curtain of gas may be directed across rather than through the electrode surfaces so as to sweep charged particles from the electrodes.

In addition to the curtains of gas which sweep the electrodes, a flow of gas or conditioned air of columnar configuration enveloping the spray stream is created by chamber 42 as in the previously described embodiments, but formed in this case by a slot configuration. A first set of oppositely disposed arcuate slots 57 and 58 are defined by concentrically disposed outer wall portions of the forward end of barrel 13 and adjacent inner wall portions of chamber 42. Between adjacent arcuate walls of lobes 43 and 44 and chambers 45 and 46, is formed a second set of slots 59 and 60. These slots cooperate with each other to channel gas supplied to chamber 42 from inlet 39 and to channel gas exiting the pores of electrodes 49 and 50 into a columnar configuration which envelopes the spray stream.

Illustrated in FIG. 7 is an embodiment of a spray gun having a gas envelope forming chamber similar to that of FIG. 6, but having a different structure for directing a flow of gas or conditioned air to sweep electrodes mounted in chambers between the outer lobes and the nozzle assembly. In this alternate form, conditioned air or gas is supplied to chamber 42 directly, rather than from outlets located in the internal piping of the spray gun chamber of FIG. 6. Chambers 45 and 46 have elongated channels 145 and 146, respectively, which extend rearwardly from mouths 47 and 48 in which the electrodes are mounted. The same chamber walls which cooperate to define chamber channels 145 and 146 also cooperate with inner walls of chamber 42 to form arcuate slot-like channels 59 and 60 as illustrated in FIG. 6. The mouths of channels 59 and 60 and of channels 145 and 146 are of approximately equal cross-sections so that gas or conditioned air contained in the rear portion of chamber 42 tends to flow through all the channels in approximately equal proportions. As in the structure of FIG. 6, gas flowing into chambers 45 and 46 exits through porous electrodes to maintain the electrodes free of deposited coating particles, while gas flowing through arcuate slot-like channels 59 and 60 and through channels 57 and 58, shown in FIG. 5, cooperate to form an envelope of gas around the spray stream to protect the coating particles from unwanted atmospheric reactions, or to catalyze the coating curing reaction, or to control the evaporation rate of solvent from the coating particles.

Illustrated in FIGS. 8 and 9 is an embodiment of a spray gun similar to that of FIGS. 5, 6 and 7, but having a still different structure for directing a flow of gas or conditioned air to sweep electrodes mounted in chambers between the outer lobes and nozzle assembly, and for forming a flow of gas into a protective envelope for the spray particle stream. Located rearwardly of gas inlet 39 on side wall 38 of chamber 42 is a second gas inlet 139 which receives a second flow of gas at a positive pressure. As depicted in FIG. 9, second inlet 139 provides a passageway for a flow of gas to chamber 42 apart from a flow of gas received at first inlet 39. Gas received at inlet 39 is directed by way of passageways 53 and 54 into contact with porous electrodes 49 and 50 mounted within chamber mouths 47 and 48, respectively, as discussed in detail above. A second flow of gas received at inlet 139 fills chamber 42 and exhausts through slots 57, 58, 59 and 60 in the form of an envelope which surrounds the stream of spray particles discharged from nozzle assembly 15.

The purpose of the structure illustrated in FIGS. 8 and 9 is to provide means for delivering a flow of gas into contact with the porous electrode separate from a flow of gas that is formed into a protective envelope surrounding the spray particle stream. The advantages of maintaining the charging electrode free of coating material and of establishing a protective envelope of gas surrounding the spray particle stream have been set forth above. Further advantages are derived from providing separate flows of gases for sweeping the electrode and for forming the envelope. For example, it is desirable that the gas exiting the porous electrodes be at a velocity sufficiently high to maintain the electrode free of stray coating particles, but not so high as to interfere with traversal of the stream of discharged spray particles from the nozzle to a substrate. On the other hand, the gas exhausting from slots 57, 58, 59 and 60 which is formed into an envelope surrounding the spray particle stream must be at a velocity sufficient to maintain the gas envelope at a substantial distance from the spray gun. Since the velocities, and hence the pressures maintaining the velocities, for the two flows of gas frequently differ, it is advantageous that a spray gun of the present invention have separate inlets and conduit or passageway means to supply separate flows of gas to the electrode chamber and to the gas envelope forming chamber.

Separate gas flow delivery means has other advantages. For example, it is frequently desirable that the gas exhausting from the electrode chambers be at a higher temperature and lower relative humidity than that of the envelope gas in order that initial partial drying of the spray particles occur just after discharge of particles from the nozzle assembly. In this manner the weight-solids percent of the particles is increased to a level that will provide quick drying of the coating material upon contact with a substrate, thereby avoiding objectionable sagging or running of the coating material at the substrate surface. With a combination of multiple flows of gas of differing humidity and temperature parameters, a fine degree of control of particle drying, after initial particle formation and during particle travel, can be achieved by varying the relative proportions of the multiple flows of gas mixing with or encircling the spray stream. Additionally, removal of volatile components from the spray particle by fast initial drying at the beginning of particle traversal from the gun to the substrate allows the particle, by lowering particle mass, to retain a higher specific electrical charge. Higher particle electric charge aids materially in improvement of coating deposition and formation upon a substrate.

Furthermore, separate gas flow delivery means allows use of differing gases within the same spraying operation. For example, it may be desirable to feed temperature and humidified atmospheric air to the electrode chambers for improved initial particle drying while providing nitrogen or other inert gas to the gas envelope forming chamber to protect the partially dried particles from further reaction with the ambient atmosphere.

It should be appreciated that the location of a second gas flow inlet 139 is shown adjacent to a first gas flow inlet 39 as a matter of convenience to aid in attachment and handling of separate gas feed hoses. Inlet 139 may be positioned at any other convenient location upon chamber 42, providing such location is spaced sufficiently apart from slots 57, 58, 59 and 60 to minimize both turbulence and localized variations in pressure of the gas within the chamber as the gas is formed into the protective envelope.

One particularly useful manner in which electrostatic charging of a spray stream is achieved by the induction charging method has been set forth in some detail in copending application Ser. No. 634,386, filed Nov. 24, 1975 and now abandoned. Induction charging is provided by connecting potential applying means, that is, a source of direct current voltage, capable of developing potentials in the range of 6 kilovolts to 20 kilovolts, to the cup-shaped or rectangular configuration electrodes of the embodiments illustrated in FIGS. 5 through 9. In actual practice, the means for connecting potential applying means to the electrodes are established at some point on the grid near the dielectric nozzle air cap 18, with conducting cables arranged conveniently to extend along or within barrel 13 and handle 12 to an externally located high voltage power supply, one side of which is maintained at a lower potential, preferably ground potential. Also preferably maintained at ground potential for reasons of safety and convenience is the supply of liquid coating material (not shown). Grounding of the liquid coating material may be achieved either by direct electrical contact with the supply of conductive material, or may be achieved by way of grounding head 61 located within barrel 31 along passageway 26, as illustrated in FIG. 4. For reasons of safety and for optimum operation of the charging means, grounding wire 62 provides an additional electrically conductive path between head 61 and the coating supply maintained at ground potential. Imposition of a voltage difference between the isolated electrodes and the grounded liquid stream emanating from liquid discharge port 21 defines a charging zone in which spray particles are formed. Spacing of the electrodes in relation to the spray particle dispersing means is somewhat critical inasmuch as the spray particles must be confined substantially entirely to passage through a region of the charging zone spaced apart from the electrodes so that spray particles do not contact the electrodes. As illustrated in FIGS. 5 through 9, substantial portions of each grid extend forwardly and rearwardly of nozzle assembly face 20. The position of the electrodes adjacent to the spray particle dispersing means or nozzle assembly can be altered, of course, to vary in distance both radially outwardly and axially with respect to the nozzle assembly to suit the charging characteristics of the coating material to be sprayed.

The magnitude of voltage required to achieve optimum charging efficiency depends upon the radius of curvature of the cup-shaped electrodes shown in FIGS. 3 and 4 or upon the radial distance between the surfaces of the rectangular lobe electrodes of FIGS. 5, 6, 7, 8 and 9 with respect to the axis of the liquid flow, on the longitudinal or axial location of the electrodes with respect to the plane of nozzle face 20, on the rates of atomizing air and liquid flow from the nozzle, and the like. Thus, as the induction charging electrodes are moved radially outwardly from the axis of the liquid flow, higher voltages are required to achieve the optimum charging efficiency. Although it would be detrimental to performance if the charging electrodes were sufficiently small or sharp, or the voltage sufficiently high, to produce corona discharges, the exact number, shape, size and spacing of the electrodes is not critical. It has been found that optimum results are obtained when the average potential gradient within the charging zone, between the charging electrodes and the liquid nozzle, is between about 5 and about 20 kilovolts per inch, and preferably is between about 10 and 14 kilovolts per inch.

The electrical potential may also be applied to the liquid supply, with the electrodes being held at the ground reference potential, thereby reversing the direction of the electrostatic field developed within the charging zone. However, this embodiment has the disadvantage of maintaining the liquid supply at a high voltage level.

As described in detail in the aforementioned copending application Ser. No. 634,386 and in U.S. Pat. No. 3,698,635 to James E. Sickles, liquid coating material atomization and electric charge imposition occur substantially simultaneously so as to create a stream of discrete electric charge bearing coating particles discharged from a spray particle dispersing means having induction charging means. In the present invention, a high voltage electrode such as that illustrated at 40, 49 or 50 of the apparatus of FIGS. 3–9, establishes an electric field between the electrode and the grounded liquid stream within nozzle assembly 15. The stream of liquid coating material which exits port 21 of nozzle assembly 15 is thrust into contact with a jet of air from concentrically disposed port 22, which jet of air impinges upon the liquid stream and tends to distort the stream into an irregular configuration comprising sharply pointed surface discontinuities. Other methods for introducing mechanical disruptions into a liquid stream for initiating particle forming discontinuities include the mechanisms of hydrostatic pressure, siphon and aspiration liquid atomizations. Formation of cusp-like, liquid stream discontinuities or "liquid termini" is aided by the high intensity electric field existing between the high voltage electrode and the grounded liquid stream. The electric field flux lines tend to concentrate at the sharp-pointed liquid termini and to induce electric charge redistribution within the liquid stream, with charge of sign opposite that of the high voltage electrode migrating to the extreme sharp edge portions of the liquid termini. Since the charges on the liquid termini and on the electrode are opposite in sign, electrical attractive forces cooperate with the mechanical distresses furnished by the jet stream of air to separate the liquid termini from the liquid stream so as to form discrete coating material particles bearing electric charge.

It should thus be apparent from the foregoing discussion that the described electrode means and potential generating means of the present invention cooperate to establish a region in an electric field within a charging zone in which spray particles become charged by induction of charges on the particles as the particles are formed by the spray particle dispersing means.

The electrostatic-charging gas-flow spray gun depicted in FIGS. 5, 6, 7, 8 and 9 also contains grounding shields as described in aforementioned copending application Ser. No. 634,386. Grounding shields, which in FIGS. 5–9 are on the exterior dielectric surfaces of the forwardly extending lobes 43 and 44, are optional but desirable because they help to prevent accumulation of spray material on the exterior surfaces of the lobes and prevent accidental sparking or electrical shock between an accumulation of charged particles on the lobes and a grounded object, such as an operator.

As shown in FIGS. 5–9, shields 63 and 64 in the form of a conductive foil are secured to the outer surfaces of lobes 43 and 44. Beads 65 secure the edges of the conductive foil shields to their respective lobes and additionally help to suppress corona charge phenomena. Although the shield electrodes 63 and 64 may be continuous in extent within the boundaries of beads 65, best results are often obtained by utilizing electrodes having cut-out interior surface portions 66 and 67 which expose the dielectric material of the supporting lobe. Shields 63 and 64 are maintained at the same ground potential as the liquid stream, as diagrammatically indicated in FIGS. 6, 7 and 9, by conductive connections (not shown) between the foils and either the grounding head 61 or the liquid supply. Centrally located within shield cut-out portions 66 and 67 are dielectric inserts 68 and 69, shown in the drawings as threaded nylon screws, which extend through lobes 43 and 44 and terminate in friction contact with the inner conductive surfaces of the electrodes mounted in the mouths of chambers 45 and 46, respectively. The purpose of inserts 68 and 69 is to provide a continuous path of dielectric material having a dielectric constant greater than that of air between the inductive charging electrodes 49 and 50 and the lobes 43 and 44, which support shielding foils 63 and 64.

The lobe shield feature just described is particularly advantageous in the lobe type spray gun embodiment wherein the gas-envelope forming chamber 42 has axially displaced arcuate slots which channel the conditioned air into a columnar-shaped flow. Because some of the gas discharges through arcuate slots 57 and 58 at an axial distance rearward of nozzle face 20 and the balance of the gas exits arcuate slots 59 and 60 forward of the nozzle, some turbulence results when the gas streams mix at the forward end of the spray gun. Under these turbulent conditions, particles at the fringes of the liquid spray stream which might be swept around and deposit upon lobes 43 and 44 are deflected by shielding electrodes 63 and 64 away from the lobes and toward the target.

Other configurations of lobe type porous electrodes utilizing induction charging techniques can be employed in the instant invention. For example, FIGS. 10 and 11 show a detachable electrode-mounting chamber 70 fabricated of dielectric material which is compatible with the gas envelope forming structure shown in FIGS. 6 and 8. The chamber has a cavity 71 opening to a mouth 72 and has an air supply inlet 73. Positionable within mouth 72 is a complementary shaped, slab-like electrode member 74 having an array of holes or passageways 75 passing through the electrode between opposite faces as shown in FIG. 12. The electrode slab 74 may be fabricated of any conductive material. Found particularly suitable for this invention are electrode slabs compressed of sintered steel powder or made of electrically conductive plastic. Alternatively, the electrode members may be constructed of slabs of non-conductive materials upon which is vapor deposited a metallic film coating. Non-porous electrode slabs are provided with holes, for example passageways 75 in FIG. 12, which are approximately 10 to 30 mils in diameter and spaced at distances of 1/16 inch to 3/16 inch apart. Alternatively, shown in FIG. 13 is an electrode compressed of sintered steel powder to a density which is sufficiently porous to pass air without the necessity of having discrete holes drilled through the slab to provide passageways for gas flow. When the slab-like porous electrode members are fitted into the detachable chambers and then mounted and wired into a lobe type spray gun device like that shown in FIGS. 6 and 8, gas supplied through inlet 73 of the chamber exits through passageways 75 to form a curtain of gas at the surface of the porous slabs thereby keeping the electrodes free of stray coating particles in the manner previously described. With an easily detachable electrode-mounting chamber, an electrostatic spray gun of the present invention can be quickly adapted to meet practically any combination of spraying conditions and coating materials.

Those skilled in the art will appreciate that the invention can be embodied in forms other than those which are herein specifically described for purposes of illustration.

What is claimed is:

1. Spray apparatus for spraying dispersed electrically charged particulate coating material in a controlled atmosphere, comprising:

a chamber having an opening, dispersing means mounted in said chamber for dispersing a stream of coating material into a spray of particles directed outwardly of the opening in the chamber, inlet means mounted in said chamber for delivering a flow of gas to said chamber, said inlet means and said dispersing means being in spaced relationship within said chamber whereby said gas exits through said opening and substantially envelops said spray, and electrode means adjacent said dispersing means, a portion of said electrode means being porous.

2. The apparatus of claim 1, wherein said dispersing means is at least partially located within the opening of said chamber to define a generally annular passageway through which said gas exits from the chamber.

3. The apparatus of claim 1, wherein at least a portion of said electrode means extends axially outwardly of said dispersing means, and wherein said dispersing means comprises a spray nozzle fabricated of dielectric material.

4. The apparatus of claim 3, further characterized by potential generating means connectable to said electrode means and connectable to said stream of coating material to create an electric field in a charging region established between said electrode means and said stream of coating material.

5. The apparatus of claim 4, wherein said electrode means and said potential generating means cooperate to electrostatically charge spray particles by inducing charge on said particles as said particles are formed by the spray particle dispersing means.

6. The apparatus of claim 1, wherein at least a portion of said electrode means is positioned to be in wiping contact with the gas delivered from said chamber inlet.

7. The apparatus of claim 1, wherein said inlet means is further characterized by (a) means mounted in said chamber for delivering to said gas envelope forming chamber a flow of gas for contacting said electrode means separate from said flow of gas for forming said envelope, and (b) means within said gas envelope forming chamber for maintaining said electrode means contacting gas flow separate from said envelope forming gas flow.

8. The apparatus of claim 1, wherein said porous electrode comprises a wire grid.

9. The apparatus of claim 8, wherein said wire grid electrode is annular shaped and disposed substantially entirely between the liquid dispersing means and the perimeter of the opening in said chamber.

10. The apparatus of claim 1, wherein said porous electrode comprises a metallic member having spaced apart holes therein.

11. The apparatus of claim 1, wherein said porous electrode comprises a conductive plastic member having spaced apart holes therein.

12. The apparatus of claim 1, wherein said porous electrode comprises sintered metal compressed into a high density slab-like member having spaced apart holes therein.

13. The apparatus of claim 1, wherein said porous electrode comprises sintered metal compressed to a low density slab-like member having porosity sufficient to pass air therethrough to maintain said electrode free of deposited coating particles.

14. The apparatus of claim 1, wherein said porous electrode comprises a non-conductive porous substrate having thereon a conductive layer.

15. The apparatus of claim 1, further comprising shielding means for said electrode means.

16. The apparatus of claim 15, in which said shielding means comprises an electrode mounted exteriorly of said electrode means.

17. The apparatus of claim 15, further comprising means completing a dielectric path between said charging electrode and said shielding means, wherein said means completing said dielectric path has a dielectric constant greater than the dielectric constant of air.

18. Electrostatic spraying apparatus of the external mixing type for applying liquid coating material to a workpiece, comprising:

dispersing means for dispersing a stream of coating material into a spray of particles, said dispersing means further comprising nozzle means for atomizing liquid coating material in a region exterior to the confines of said nozzle means;

electrode means disposed adjacent to said dispersing means to define a region wherein electrostatic charge is imparted to spray particles, a portion of said electrode means being porous;

connecting means for connecting a potential source to said spraying apparatus for imposing electrical potential in said region of electrostatic particle charging; and means for directing a flow of gas into contact with said electrode means to maintain said electrode means substantially free of deposited coating particles.

19. The apparatus of claim 18, wherein said dispersing means is a spray nozzle fabricated of a dielectric material.

20. The apparatus of claim 19, wherein said electrode means and potential applying means cooperate to impose electric charge upon coating particles dispersed by said dielectric spray nozzle by electrostatic induction charging.

21. The apparatus of claim 18, wherein said gas directing means for said electrode means comprises at least one chamber having inlet means for receiving said flow of gas and having spaced from said inlet means an opening in one wall portion of said chamber within which said electrode means is mounted.

22. The apparatus of claim 18, further characterized by means for forming a flow of gas into an envelope which substantially surrounds the stream of spray particles discharged from said spray particle dispersing means.

23. The apparatus of claim 22, wherein said gas envelope forming means comprises a chamber having an inlet for receiving said flow of gas and having spaced therefrom an opening surrounding a portion of said spray particle dispersing means.

24. The apparatus of claim 23 further characterized by means within said gas envelope forming chamber for maintaining said flow of gas for forming the envelope separate from said flow of gas contacting the electrode means.

25. The apparatus of claim 18, wherein said porous electrode means comprises a wire grid.

26. The apparatus of claim 18, wherein said porous electrode comprises a solid, slab-like member having spaced apart holes therein.

27. The apparatus of claim 18, wherein said porous electrode comprises a solid slab-like member of a non-conductive material upon which is supported a conductive layer and which has spaced apart holes therein.

28. The apparatus of claim 18, wherein said porous electrode comprises sintered metal compressed into a high density slab-like member having spaced apart holes therein.

29. The apparatus of claim 18, wherein said porous electrode comprises sintered metal compressed to a low density slab-like member of porosity sufficient to pass a gas therethrough to maintain said electrode free of deposited coating particles.

30. The apparatus of claim 18, further comprising shielding means for said charging electrode means.

31. The apparatus of claim 30, in which said shielding means comprises an electrode mounted exteriorly of said electrode means.

32. The apparatus of claim 30, further comprising means completing a dielectric path between said charging electrode means and said shielding means, wherein said means completing said dielectric path has a dielectric constant greater than the dielectric constant of air.

33. Electrostatic induction charging adapter for use in association with external-mixing type, liquid material spray particle dispersing means, comprising:

support means;

mounting means on said support means for mounting the adapter on said external-mixing spray particle liquid material dispersing means;

electrode means secured to said support means, at least a portion of said electrode means being porous, said electrode means disposed adjacent said spray particle dispersing means defining a charging zone in which said spray particles are formed when said adapter is mounted on said spray particle dispersing means, said spray particles being confined substantially entirely to passage through a region of said zone, which region is spaced apart from the electrode means;

means for connecting potential applying means to said eleotrode means for imposing electrical potential across said region of particle charging; and means secured to said support means for (a) directing a flow of gas into contact with said electrode means, and (b) forming a flow of gas into an envelope which substantially surrounds a stream of spray particles discharged from said spray particle dispersing means when said adapter is mounted in operative association with said spray particle dispersing means.

34. The apparatus of claim 33, wherein said gas directing means for said electrode means comprises at least one chamber, said electrode means gas directing chamber having inlet means for receiving said flow of gas and having spaced from said inlet means an opening in one end portion of said chamber, a portion of said porous electrode means disposed within said opening.

35. The apparatus of claim 34, further comprising shielding means for said charging electrode means.

36. The apparatus of claim 35, in which said shielding means comprises an electrode mounted exteriorly of said chamber surrounding said electrode.

37. The apparatus of claim 33, wherein said gas envelope forming means comprises a chamber having an inlet for receiving said flow of gas for forming an envelope and having spaced from said inlet an opening surrounding a portion of said spray particle dispersing means when said adapter is mounted in operative connection with said spray particle dispersing means.

38. The apparatus of claim 37 further characterized by means within said gas envelope forming chamber for maintaining said flow of gas for forming the envelope separate from said flow of gas contacting the electrode means when said adapter is mounted in operative connection with said spray particle dispersing means.

* * * * *